US005927033A

United States Patent [19]

Kreckl

[11] Patent Number: 5,927,033

[45] Date of Patent: Jul. 27, 1999

[54] SYSTEM FOR LAYING WALL OR FLOOR TILES, OR WALL OR FLOOR PLATES

[76] Inventor: Helmut Kreckl, Am Bauernfeind 43, 92507 Nabburg/Diendorf, Germany

[21] Appl. No.: 08/716,715

[22] Filed: Sep. 12, 1996

[30] Foreign Application Priority Data

Sep. 18, 1995 [DE] Germany ..... 295 14 938 U

[51] Int. Cl.[6] ..... E04F 13/08; E04F 15/022

[52] U.S. Cl. ..... 52/390; 52/506.01; 52/747.11; 52/DIG. 4; 156/71; 156/310

[58] Field of Search ..... 52/390, 391, 392, 52/506.01, 746.1, 747.11, DIG. 4; 156/71, 310

[56] References Cited

U.S. PATENT DOCUMENTS

| | | | |
|---|---|---|---|
| 3,102,314 | 9/1963 | Alderfer | 52/DIG. 4 X |
| 3,243,374 | 3/1966 | Gillard | 52/DIG. 4 X |
| 3,341,996 | 9/1967 | Jones et al. | 52/DIG. 4 X |
| 3,378,974 | 4/1968 | Bush, Jr. | 52/DIG. 4 X |
| 3,559,358 | 2/1971 | Lohse et al. | 52/391 X |
| 3,629,756 | 12/1971 | Holtz | 52/DIG. 4 X |
| 5,116,439 | 5/1992 | Raus | 52/746.1 X |
| 5,238,721 | 8/1993 | Nakazawa | 52/392 X |
| 5,255,482 | 10/1993 | Whitacre | 52/392 X |
| 5,271,200 | 12/1993 | Witt | 52/391 |
| 5,476,559 | 12/1995 | Chiro | 52/DIG. 4 X |

FOREIGN PATENT DOCUMENTS

| | | | |
|---|---|---|---|
| 2903213 | 7/1980 | Germany | 52/DIG. 4 X |
| 4234792 | 5/1993 | Germany | 52/DIG. 4 X |
| 1573492 | 8/1980 | United Kingdom | 52/DIG. 4 X |

*Primary Examiner*—Carl D. Friedman
*Assistant Examiner*—Kevin D. Wilkens
*Attorney, Agent, or Firm*—Hoffman, Wasson & Gitler, P.C

[57] ABSTRACT

A tiling or plating system for removably laying wall or floor tiles or wall or floor plates on a surface such as a floor or wall including a magnetically conductive support layer made of metal or the like and a magnetic layer applied to the rear side of the tiles or plates, the magnetic layer being magnetically adhered to the support layer.

6 Claims, 1 Drawing Sheet

SYSTEM FOR LAYING WALL OR FLOOR TILES, OR WALL OR FLOOR PLATES

BACKGROUND OF THE INVENTION

This invention refers to the laying of wall or floor tiles, or wall or floor plates.

Tiles or plates are laid outdoors and indoors by means of mortar, adhesive or the like on plaster, pavement or the like in a fixed manner. The tiles or plates cannot be removed without being damaged. Exchanging the tiles or plates is very difficult and is usually carried out by an expert. In many cases, it is desirable to change individual tiles or plates, or a group of tiles or plates, because predetermined tiles or plates have been broken and are to be replaced. In addition, tiles or plates are replaced for decorative reasons and new tiles or plates are laid, which have a color or decor different from the former ones.

It is an object of this invention to provide a system according to which wall or floor tiles, or wall or floor plates, can be removably connected with the respective foundation, for example a wall or floor surface, in such a manner that the tiles or plates can be removed from the foundation in an easy manner and can be laid on the foundation again without damaging the tiles or the foundation. There is no requirement to apply a binder composition when re-laying the tiles or plates.

SUMMARY OF THE INVENTION

Accordingly, a compensating and contact layer is fastened on the plaster or the floor finish or the raw concrete, which layer preferably is flexible in order to compensate for any wall unevenness. A continuous or non-continuous plate or a plurality of plates is applied, for example bonded to said compensating and contact layer, which plates are made of magnetically conductive material, for example steel or high-grade steel, electrically conductive plastic material or the like, and which form the supporting layer attached to the wall or floor for adhering the tiles or plates.

BRIEF DESCRIPTION OF THE DRAWINGS

The following two embodiments of the subject invention are described in connection with the drawings.

BRIEF DESCRIPTION OF THE PREFERRED EMBODIMENTS

Figure 1:
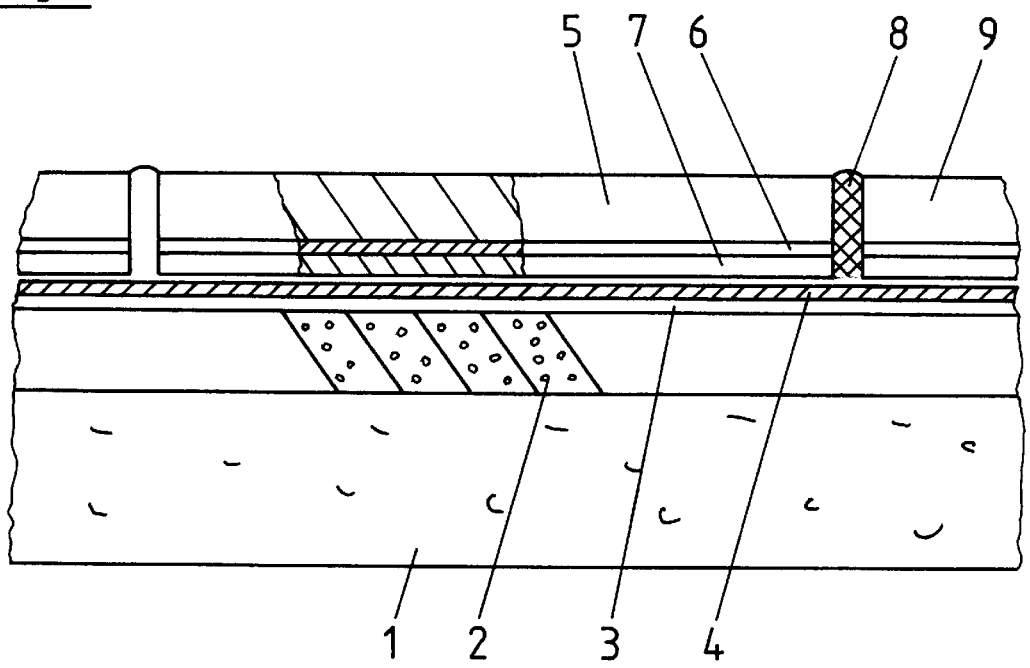
FIG. 1 shows a cross-section through a wall or a floor with wall or floor tiles, or wall or floor plates laid thereon, as well the laying system according to this invention.

As shown in FIG. 1, upon a surface of raw concrete 1 with a floor finish 2 or plaster, or alternatively upon a brick wall 1 with plaster 2, a compensating and contact layer 3 is applied, to which a continuous or discontinuous support layer 4 formed as a large-area sheet-like plate or formed as stripes of metal, steel, noble steel, plastics (at least metallized at the outer surface) is attached, for example bonded. The sheet-like plate 4 of metal, or the like, forms the support layer attached to the floor surface or the wall surface, to which the floor or wall plate 5, or the floor or wall tiles 5, are applied. The plates or tiles comprise the actual tile or plate 5. A contact layer 6 is firmly connected with the back side of the tile or plate 5. The contact layer can be made from ceramics, metal or the like, and is suitable for receiving a magnetic foil 7, which forms the rear side of the tile or plate 5. Instead of a thin magnetic foil having a 0.6 or 0.8 or 1.0 mm thickness, or even thicker, a magnetic layer can be used, which covers the entire surface of the tile or plate, or is applied in the form of stripes or a circle. This layer also can be a layer of plastic material, which is provided with magnetic particles, especially at the side facing the support layer. It is important for the subject invention that the magnetically active back side, of the tiles or plates, exerts a magnetic attraction force onto the support layer, which is made of metal or is metallized so that the magnetic force lines generate the attraction or adhesion between the tile or plate and the support carrier, and thus an attachment is obtained, which can be released in a most simple manner. Adjacent tiles or plates 5 and 9 are separated from each other by a joint 8, which is filled with a joint filler composition on an acrylic basis, a silicon material or the like, which is magnetically conductive, too. Alternatively, a non-magnetic or non-magnetized joint filler composition can be used, which at its outer side is covered by means of a magnetized metal tape 241. This joint tape also can be used as a grounded wire.

Figure 2:
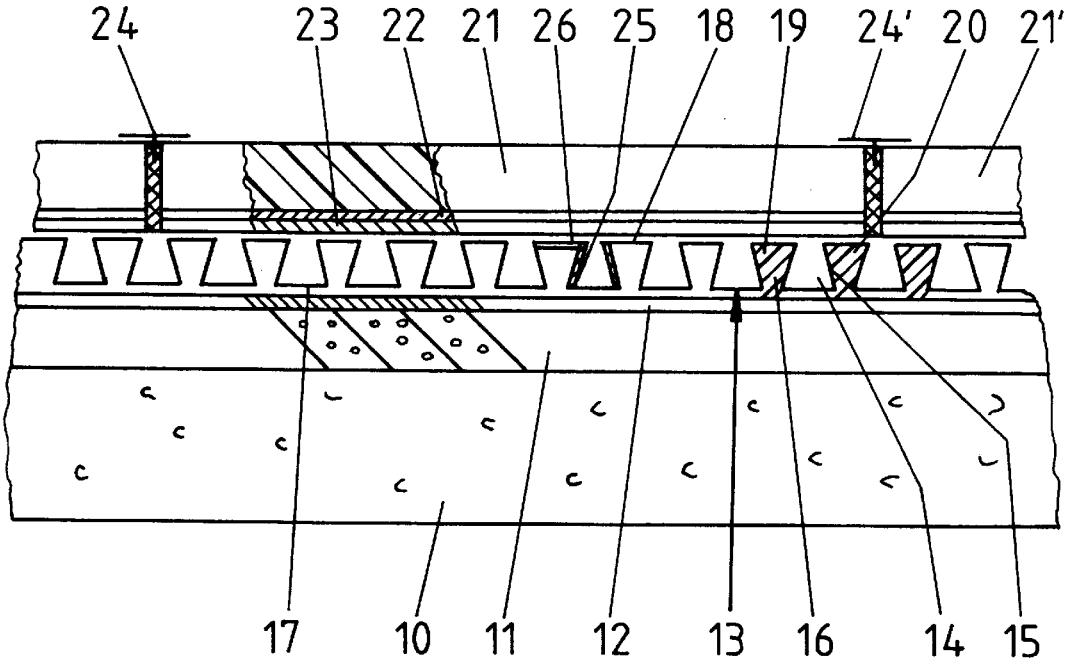
FIG. 2 shows a cross-section of a further embodiment of the laying system according to this invention.

According to the embodiment of FIG. 2, the laying of floor plates or tiles on a floor foundation is shown in combination with a structure of the support layer, which is different from the structure according to FIG. 1 However, said structure is similar for wall tiles as well as for wall plates. The raw concrete layer 10 is provided with a sloping floor finish 11 for evacuating water, to which a compensating and contact layer 12 is attached, for example bonded, which is connected, for example by an adhesive, with an overlaying support layer 13; said layer 13 according to FIG. 2 is a profiled plate made f sheet metal, a steel sheet or a metallized, profiled plastic material. The profile is made up from grooves, which extend parallel to each other and are of trapezoidal cross-section, the upper side of which has an aperture of restricted width and the bottom 17 of which is of larger width. Between two apertures 16, a surface section 18 of the support layer is provided, the surface area of which is substantially wider than that of the aperture 16. The entirety of said surface sections 18, 19, 20 . . . extending parallel to each other forms the entire support area, to which the plates 21 with the applied contact layer 22 and magnetic foil attached thereto are applied. The material filling the joint 24 is located between two adjacent plates 21, 21'.

The magnetic foil 23, which can be a plastic foil comprising magnetic particles embedded within the plastic material, has a thickness of 0.6–1.2 mm, however, can be of larger thickness and can be flexible, in order to obtain an optimum contact area with the support layer. The profiled plate 14 made of steel or sheet metal with its support surface sections 18, 19, 20 . . . for example is made of sheet metal with a thickness of 0.8 or 1.0 mm, and can be provided with an insulation. The embodiment according to FIG. 2 in view of the profiled plate 14 of steel or sheet metal allows for dewatering of any leaking water, and the like.

The insulation or filler can be placed in the recesses formed between the trapezoidal areas and can include polyurethane foam for noise insulation and concrete for mechanical stability.

The walls restricting the groove-like recesses can be made of metal reinforced polyvinyl chloride 25 and surfaces forming a support structure for receiving the tiles are provided with metallic layers 26 for stability.

The wall or floor tiles, or the wall or floor plates on their backside, which is the side facing the supporting layer, are provided with a magnetic foil bonded to the tile or plate through the contacting layer by means of an adhesive or the like. The magnetic foil is applied across the full surface or at interrupted portions, for example in stripes or spots. If the tile or plate is applied to the support layer at the wall or floor surface, it adheres thereon by magnetic forces and can be shifted along the surface, or can be removed and replaced by a different tile or plate in a very simple manner.

Alternatively, magnetic foils on the tiles or plates on the one hand and supporting layers on the wall or floor on the other hand, can be exchanged. Especially, the magnetic foil can be formed as a magnetic layer on the back side of the wall or the floor tile or the plate or can be made of flexible material so that the tile or plate can be pressed against the supporting layer and a full-surface support can be reached. The tiles or plates are attached by means of an elastic material, for example on an acrylic basis or silicon basis, which material can be easily removed, when a tile or plate is to be exchanged so that removing and exchanging the tile can be accomplished by simply lifting it and applying another tile in its place at any time, without damaging the supporting layer or the wall or the floor tile attached to the supporting layer.

According to a further embodiment of this invention, the support layer is made from a profiled plate rather than from a planar supporting layer, such as a plate made from steel or a different metal or a metalized material, for example in such a manner that said plate is constructed from a plurality of parallel grooves with a trapezoidal cross-section, whereby the outer surface of the trapezoid is open and the opposite inner side of the trapezoid is closed, and the width of the opening is substantially smaller than the width of the bottom. In this manner, an interrupted outer surface with a large cross-section area and thus a large contact area will be obtained for the tiles or plates to be applied; at the same time the entire structure of the supporting layer is formed substantially flexible so that any irregularities within the surface of the back side of the tiles or plates will be compensated and a close contact will be obtained.

I claim:

1. A tiling system for removably laying tiles on a surface, said tiling system comprising:

a) a support structure comprising a rigid support plate bonded to said surface;

b) a magnetically conductive layer applied onto said support structure, said magnetically conductive layer is a metal plate, or metallized strips;

c) a plurality of tiles having bonded to their back side a magnetic layer, said plurality of tiles and said magnetic layer being removably attached to said support structure by magnetically adhering them to said magnetically conductive layer;

d) said plurality of tiles, when attached to said support structure, are arranged with joints formed between said plurality of tiles, said joints are filled with a magnetically conductive flexible joint filling compound selected from the group consisting of an acrylic and a silicon material.

2. A tiling system according to claim 1, wherein said joints are bridged by a magnetic or a magnetizable joint tape, wherein said tape is used as a grounded wire.

3. A tiling system as claimed in claim 1, wherein said magnetically conductive layer is a surface profiled with groove-like recesses extending parallel to each other, said groove-like recesses being of trapezoidal cross-section with an open area of each trapezoidal recess having a substantially smaller width than a bottom area of each recess.

4. A tiling system as claimed in claim 3, wherein the surface of the magnetically conductive layer between adjacent open sides of adjacent trapezoidal recesses forms a support structure for receiving said tiles.

5. A system as claimed in claim 4, wherein walls forming said groove-like recesses are made of polyvinyl chloride, and surfaces forming said support structure are provided with metallic layers.

6. A system as claimed in claim 3, wherein said trapezoidal recesses are filled with a material selected from the group consisting of polyurethane foam and concrete.

* * * * *